United States Patent [19]

Welp et al.

[11] Patent Number: 4,909,454

[45] Date of Patent: Mar. 20, 1990

[54] APPARATUS FOR INSERTING A WINDING SLEEVE OR CORE INTO A WINDING MACHINE

[75] Inventors: Ewald G. Welp, Erkrath; Waldemar Neumann; Reinhald Hehner, both of Haan; Georg Müller, Neuss; Hartmut Dropczynski, Dormagen; Luzian Kies, Düsseldorf, all of Fed. Rep. of Germany

[73] Assignee: Jagenberg Aktiengesellschaft, Dusseldorf, Fed. Rep. of Germany

[21] Appl. No.: 89,891

[22] Filed: Aug. 26, 1987

[30] Foreign Application Priority Data

Aug. 27, 1986 [DE] Fed. Rep. of Germany ..... 3629024

[51] Int. Cl.[4] ..... B65H 18/16; B65H 19/30

[52] U.S. Cl. ..... 242/65; 242/56.4

[58] Field of Search ..... 242/65, 66, 56.4, 56.3, 242/56.2

[56] References Cited

U.S. PATENT DOCUMENTS

| | | | |
|---|---|---|---|
| 4,422,588 | 12/1983 | Nowisch | 242/66 X |
| 4,508,283 | 4/1985 | Beisswanger | 242/66 X |
| 4,550,887 | 11/1985 | Schomeier | 242/65 X |
| 4,697,755 | 10/1987 | Kataoka | 242/56.4 |
| 4,749,140 | 6/1988 | Ruff | 242/66 X |

FOREIGN PATENT DOCUMENTS

| | | |
|---|---|---|
| 2352585 | 5/1974 | Fed. Rep. of Germany . |
| 3243994 | -5/1984 | Fed. Rep. of Germany . |

*Primary Examiner*—John M. Jillions
*Attorney, Agent, or Firm*—Herbert Dubno

[57] ABSTRACT

The apparatus for inserting a winding sleeve in a winding machine includes at least one supporting roll, at least two adjustable winder support pieces with spindles positioned opposite each other for receiving the winding sleeve and at least one sleeve gripper pivotable between a sleeve receiving position and a sleeve delivery position alignable axially with the spindles. The sleeve gripper can be mounted on a guide crosspiece above the supporting roll or alternatively pivotally and telescopably on a press roller mount or other crosspiece on one side of the supporting roll.

4 Claims, 7 Drawing Sheets

APPARATUS FOR INSERTING A WINDING SLEEVE OR CORE INTO A WINDING MACHINE

FIELD OF THE INVENTION

Our present invention relates to an apparatus for inserting or mounting a winding sleeve into a winding machine.

BACKGROUND OF THE INVENTION

An apparatus for supplying a winding sleeve on a winding machine can comprise at least one supporting roll and at least two support members with a plurality of mandrels positioned opposite each other for receiving the winding sleeve.

In this winding machine the sheet of goods, e.g. a paper web or strip, extending over the width of the supporting roll is cut through after the winding rolls have attained a predetermined diameter and the finished roll has been ejected. Thereafter the empty winding sleeves are mounted manually upon the mandrels of the support member and then brought to their winding position on the supporting roll. To attach the leading end of the web to the empty winding sleeve, the leading end is held with an adhesive material applied to the web end or the sleeve.

This process is very time consuming since a winding machine can have five or more winding stations which are located on both sides of the longitudinal central plane of the supporting roll(s) so that the introduction of the winding sleeves must occur manually in succession at each winding station. After mounting, the empty winding sleeves must be moved manually against the supporting roll so that they are located in the winding position determined by the adhesive means which however is different for the winding stations on the one side of the machine in contrast to those on the other side.

The work which must be performed in the vicinity of the winding support above the supporting roll is not without danger so that as a result of the required safety steps an additional delay in operation occurs.

OBJECTS OF THE INVENTION

It is an object of our invention to provide an improved apparatus for mounting a winding sleeve in a winding machine which obviates these drawbacks.

It is also an object of our invention to provide an improved apparatus for mounting a winding sleeve in a winding machine which simplifies the insertion thereof.

It is another object of our invention to provide an improved apparatus for mounting a winding sleeve in a winding machine which speeds the operation of the winding machine.

It is an additional object of our invention to provide an improved apparatus for mounting a winding sleeve in a winding machine which permits a more fully automatic operation.

SUMMARY OF THE INVENTION

These objects and others which will become more readily apparent hereinafter re attained in accordance with our invention in an apparatus for inserting a winding sleeve into a winding machine comprising at least one supporting roll and at least two winder support members with respective mandrels positioned opposite one another for receiving the winding sleeve.

According to our invention the apparatus further comprises at least one sleeve gripper movable between a sleeve-receiving position and a sleeve-delivery position substantially axially alignable with the mandrels.

The sleeve-receiving position is located exteriorly to the supporting roll so that the sleeve may be put either manually on the sleeve gripper without danger or automatically taken up by the sleeve gripper.

The sleeve gripper can be mounted above the supporting roll pivotable between the sleeve-receiving position and the sleeve-delivery position transverse to the supporting roll axis. The sleeve-receiving position in this case is located above the supporting roll approximately in its longitudinal central plane in a space which is also accessible when the winding roll has attained its full diameter.

It is particularly appropriate for mounting the sleeve gripper that the sleeve gripper be pivotally mounted on a guide crossmember located above the supporting roll which acts as support and guide for the winder support member.

When the pivot axis for the sleeve gripper is located in the region below the guide crossmember, a sleeve clamp may be located under this pivot axis in the vicinity of the supporting roll. Thereby that the sleeve-receiving position is approximately in the longitudinal central plane above the supporting roll and the sleeve-delivery position is pivoted out to one side from the longitudinal central plane.

To bring the sleeve gripper into the sleeve-receiving position above the supporting roll and into the sleeve-delivery position to one side of the central longitudinal plane of the supporting roll in the vicinity of the mandrel on the winder support member, the sleeve gripper can also be telescopable.

The sleeve gripper can be slidably mounted on a carriage on guide rods on the guide crossmember so that a fit to different web formats and, additionally, extension of the sleeve gripper in the direction of the supporting roller axis is possible. During operation the carriage(s) can be held fixed by a locking engagement between the carriages and the guide crossmember.

The winding rolls are located on both sides of the central longitudinal plane of the supporting roll with end faces aligned pairwise and two sleeve grippers pivotable in opposite directions may be mounted on each carriage.

To put the sleeve on the sleeve gripper during winding, the guide rods are extended beyond the length of the supporting roll.

A plurality of sleeve grippers and carriages can be provided. These can be coupled by a plurality of spacing retainers. The carriages with the sleeve grippers may be pulled from the winding machine equipped with sleeves and again pushed in the winding machine. Thus the sleeves push with their front ends on one another and the sleeve pushed first into the winding machine pushes against a stop member or contacting member whereby the position of all the sleeves is determined in regard to the winding stations.

If the longitudinal tolerances of the winding sleeves are insufficient with respect to the spacing of the winding stations and sufficient space does exist in line with the supporting roll, the carriages may be coupled with one another by spacing retainers according to the length of the inserted sleeves. This allows the carriages with the sleeve grippers to be shifted collectively from the winding machine. It is assumed that the guide rods or guides for the carriages are extended according to the total length of the inserted winding sleeves somewhat beyond the length of the supporting roll.

At least one sleeve gripper can be mounted on one of the winder support members. In this case it is required that the sleeve be engaged by the sleeve gripper in the vicinity of the winding station.

Independently of whether the sleeve gripper is mounted on a carriage or on a support member slidable in the direction of the supporting roller axis, the sleeve gripper in its simplest form comprises a carrier (or support), a sliding mount (or carriage) which is mounted slidably on the carrier and a sleeve clamp holder pivotally mounted on the sliding mount.

A first hydraulic or pneumatic piston cylinder unit or an electric motor unit is connected between the carrier and the sliding mount. A second hydraulic or pneumatic piston cylinder unit is positioned between the sliding mount and the sleeve clamp holder. These piston cylinders slide the sliding mount relative to the carrier and pivot the sleeve clamp holder relative to the sliding mount.

In this example the pivot axis for the sleeve clamp holder is located centrally between the sleeve clamp and the attachment on the guide crossmember.

The sleeve gripper can also comprise a sliding support, a pivoting holder which is pivotally mounted on the sliding support and a sleeve clamp holder formed as a carriage. The sliding of the sliding support and the pivoting of the sleeve clamp holder can be effected by a third and fourth hydraulic or pneumatic piston-and-cylinder unit or an electric motor unit. These can advantageously be mounted between the sliding support and the pivoting holder and between the pivoting holder and the sleeve clamp holder, respectively.

Advantageously the telescoping and pivoting of the sleeve gripper may be performed by a single device when a slider guide for the sleeve clamp holder formed as a carriage is a part of a sliding member coupled by a linking member with the sliding supports guided on the pivotally mounted pivoting holder. In this case, however, it is required that the pivoting and the telescoping be controlled so that no erroneous motion occurs.

It is particularly advantageous for control of the course of the telescoping and pivoting motion that the sliding member be divided into two. Also advantageously, an upper sliding member portion may be coupled with the linking member and a lower sliding member portion support the slider guide for the sleeve clamp holder.

In this case the third and fourth hydraulic or pneumatic piston-and-cylinder unit can advantageously be positioned between the pivotable slider guide and the lower sliding member portion and between the lower sliding member portion and the sleeve clamp holder, respectively.

Additionally the displacement of the upper sliding member portion is limited by two stop members located on the pivotable slider guide; the displacement of the lower sliding member portion is limited by one limiting member located on the upper sliding portion member and by another of the limiting members located on the pivoting holder; and the displacement of the sleeve clamp holder is limited by a contacting member at the lower sliding member portion.

Springs are mounted between the lower sliding member portions and the sleeve clamp holder, one of which is a tension spring and the other of which is a compression spring. They are provided so that the sleeve gripper is swung out before telescoping and the sleeve clamp is closed before retracting the sleeve clamp holder.

For this purpose, the fourth piston-and-cylinder unit coupled with the lower sliding member portion and the sleeve clamp holder does not engage the sleeve clamp holder directly. Instead, this holder is coupled therewith indirectly by a closing lever connection with the sleeve clamp.

To synchronize both jaws of the sleeve clamp, the jaws can be coupled with one another by gearing.

An additional means to control the sleeve receipt and the sleeve-delivery according to the position of the sleeve gripper comprises a bolt cooperating with the sleeve clamp holder and the carrier which is supported movably on the pivotable slider guide. In the swung in position of the sleeve gripper this bolt is unlocked while in the swung out position it holds the sleeve clamp holder in the extended position. Thereby opening of the sleeve clamp in the sleeve-delivery position is possible without sliding the sleeve clamp holder.

It is also possible to mount the support or carrier of the sleeve gripper on the sliding mount or on one of the carriages so that it is slidably mounted transversely to the supporting roll axis.

When the sleeve gripper is not axially slidable, the sleeve must be taken from the sleeve gripper in the vicinity of the winding station so the sleeve must be brought from the outside into the sleeve-receiving position.

A grooved sleeve member can be mounted in the vicinity of the sleeve-receiving position of the sleeve gripper above the supporting roll, advantageously over the length of the supporting roll.

In this grooved sleeve member the winding sleeves are pushed from one end of the supporting roll with their facing ends pushing on one another until they are located in the vicinity of each winding station. The sleeve grooved member can be slidably mounted on a bearing member mounted on the winder support member by at least one guide rail. Advantageously the bearing member comprises a plurality of rollers. To avoid sliding of the sleeve clamp holders the grooved sleeve member is adjustable in height.

The sleeve gripper can be a simple pivot lever. Its pivot axis can be located above the supporting roll and the sleeve clamp directed in the sleeve-receiving position upwardly to the guide crossmember. In this example the sleeve gripper formed as a pivot lever is mounted advantageously on the support member. According to the position of the pivot axis and removal of the mandrel to the support member, it is enough to construct the pivot lever unextendable or nontelescoping.

In regard to that the pivot lever lies approximately horizontal in the sleeve-delivery position. Consequently it is necessary to make the sleeve clamp pivotable on the end of the pivot lever to allow a pivoting back of the pivot lever after transferring the sleeve to the mandrel of the support frame.

In this example at least one sleeve carrier for each of the sleeves can be mounted on a guide crossmember running above the supporting roll above the sleeve. These sleeve carriers transfer the sleeve to the sleeve gripper and swing them out to transfer the sleeve to the mandrel of the support member.

Advantageously each sleeve carrier comprises a sleeve clamp opening to the sleeve gripper which is mounted on a carriage on guides or guide rods on the guide crossmember. When these guides or guide rods are extended out beyond the length of the supporting rolls as in one of the other examples, the sleeves may be inserted on sleeve carriers outside of the winding machines.

In cases in which the sleeve clamps may open sufficiently on the pivot lever, the sleeve inserted on the sleeve carrier is pushed axially by the sleeve clamp to the pivot lever. It is grasped on closing of the sleeve jaws or the sleeve clamp and moves out from the sleeve carrier on pivoting of the pivot lever, assuming this sleeve carrier may pivot, for example, against the restoring force of a spring and open.

In a winding machine with at least one pivotable press roller arm mounted pivotally on a press roller mount arranged parallel to the supporting roll, the sleeve gripper may be on the press roller mount. The pivotable press roller arm may comprise a sleeve gripper when a sleeve clamp is mounted on the pivotable press roller arm which holds the empty sleeve in contact with the press rollers on the pivotable press roller arm.

When the pivotable press roller arm does not rest on the roll during the entire winding process but is pivoted back after a time, the sleeve can be inserted manually in the sleeve clamp positioned on the pivotable press roller. In case the pivotable press roller arm is not sufficiently pivoted back from the base, an additional pivot joint ca be provided in the pivotable press roller arm. This has the advantage that the sleeve is precisely continuously positionable in the vicinity of the mandrel on the support member, independently of its diameter, without which an expensive mechanism is required to position the sleeve.

Another example of a sleeve gripper mounted on a press roller mount comprises a telescoping pivot lever provided on its free end with a sleeve clamp. This pivot lever can, similar to the above-mentioned pivotable press roller arm, be swung from its sleeve-receiving position in which the sleeve is inserted on the sleeve gripper into its sleeve-delivery position in which the sleeve is delivered to the mandrel on the support frame. To fit the pivot lever to the format of the roller, the pivot lever is advantageously mounted in a pivot position of a carriage slidable on the press roller mount.

The sleeve gripper must be of adjustable height to cause the pivot lever to swing under the press roller mount so that the sleeve-delivery position can be reached from the sleeve-receiving position. The press roller mount can be raisable and lowerable or the sleeve gripper can be raisable and lowerable on the press roller mount.

In case the sleeves should not be inserted manually in the sleeve gripper mounted on the press roller mount the sleeve gripper need not be formed as a pivot lever but it is sufficient to provide a telescoping sleeve gripper with a sleeve clamp on a carriage slidable on the press roller mount. In this case the sleeve clamp takes the sleeve from an upper grooved sleeve member mounted above the supporting roll. Since the sleeve-delivery position lies deeper than the sleeve-receiving position it is also required to construct the press roller mount or the sleeve gripper on the press roller mount so as to be raisable and lowerable.

BRIEF DESCRIPTION OF THE DRAWING

The above and other objects, features and advantages of our invention will become more readily apparent from the following description, reference being made to the accompanying highly diagrammatic drawing in which.

SPECIFIED DESCRIPTION

Figure 1:
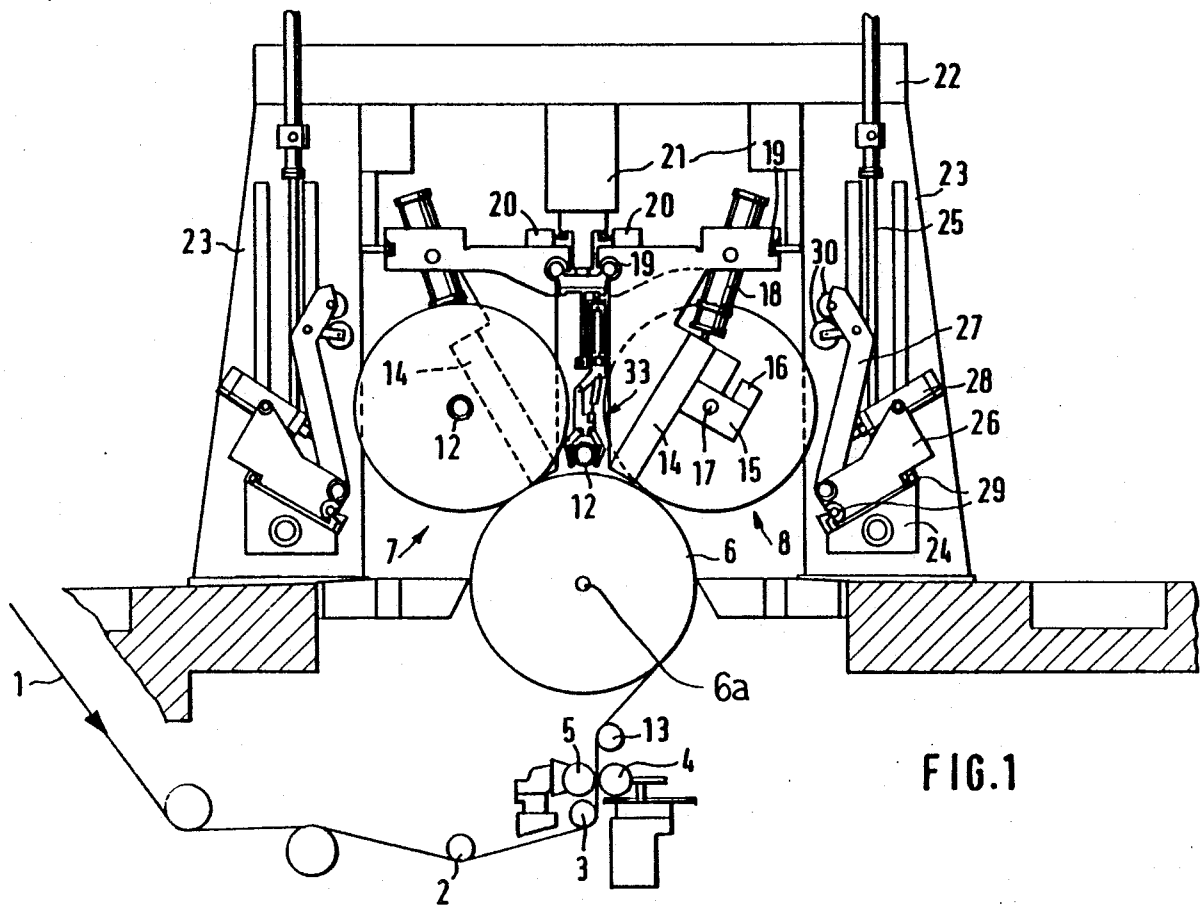
FIG. 1 is a schematic side elevational view of a winding machine with a winding sleeve gripper according to our invention.

Only the parts of the winding machines with the various respective winding grippers are shown which are important to our invention. A web of material 1, for example a web of paper, is fed by a guide roller 2 and a deflection roller 3 to a longitudinal cutter comprising upper knives 4 and lower knives 5 and is divided into a row of narrower continuous paper webs which are wound in a winding machine into respective rolls. The paper webs reach supporting roll 6 which is a suction roll which supports the wound roll of goods and is rotated by the winding about the supporting roll axis 6*a*.

Figure 3:
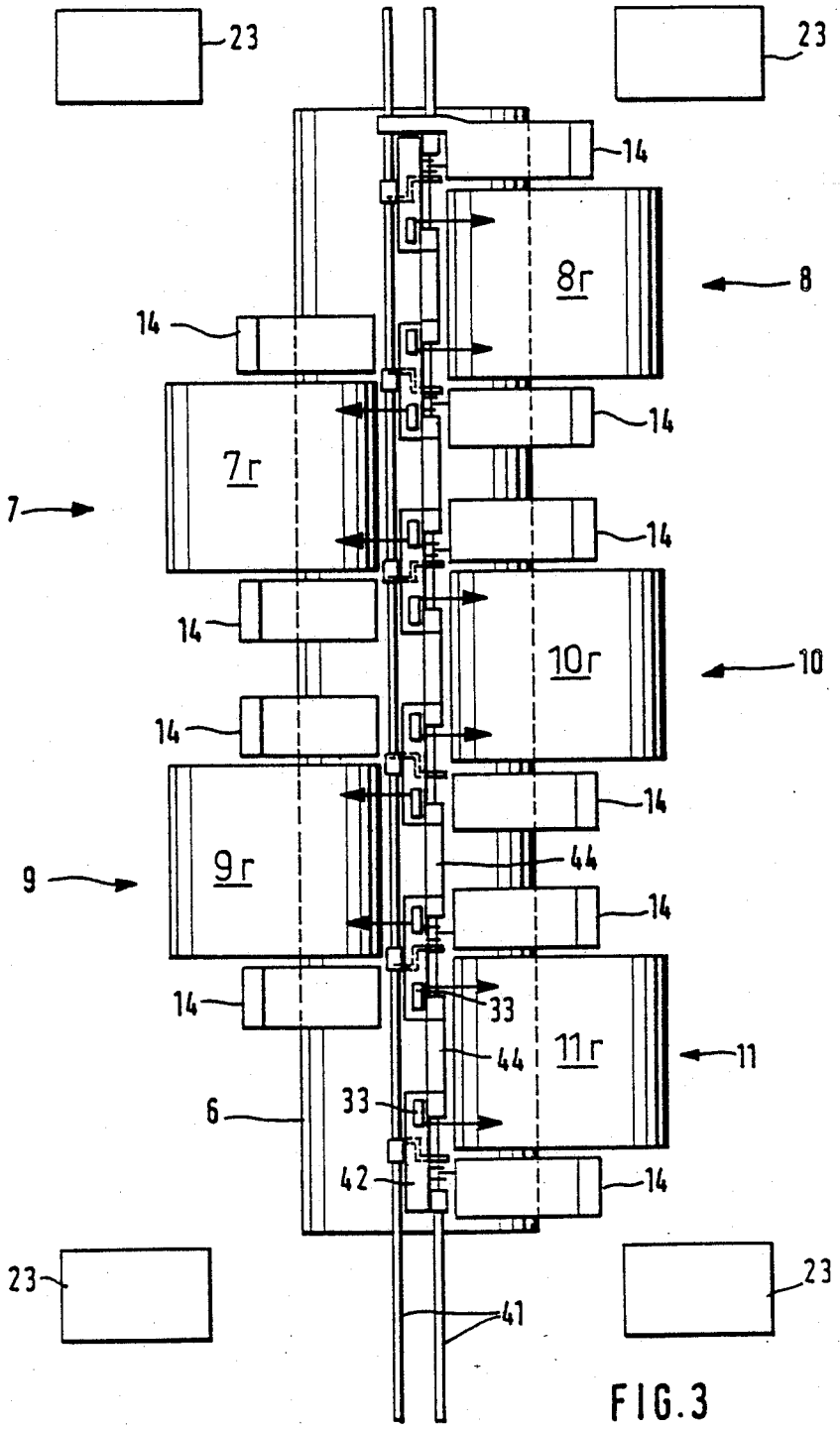
FIG. 3 is a schematic top view of the winding machine according to our invention.

In FIG. 3 five winding stations 7 to 11 are positioned above the supporting roll 6 however to one or the other side of the perpendicular longitudinal plane of the supporting roll 6. The winding core for each roll comprises a winding sleeve 12.

The winding sleeves 12 are guided on the winder support members 14 by mandrels 17 pairwise alternatingly on the one or the other side of the longitudinal central plane of the supporting roll 6.

To fit the increasing diameter of the wound rolls 7*r* to 11*r* a winder sliding member 15 is mounted on each of the winder support members 14 which are movable along a guide on the winder support member 14 by a hydraulic or pneumatic piston-and-cylinder device 18. The mandrels 17 may be axially slid by a traveller motor 16 mounted on each winder sliding member 15 to release or take the winding sleeve 12.

The winder support members 14 are slidably mounted on guide members 19 in a guide crossmember 21 extending in an axial direction of the supporting roll 6 and may adjust themselves to the required winding width by a traveller motor 20. The guide crossmember 21 is mounted on crossmember support 22 supported by upright supporting members 23.

In the illustrated winding machine an additional pressure is exerted at the beginning on the next still flexible round sleeve during the first winding. This is achieved by press roller arms 27 with press roller 30 mounted on a vertically travelling press roller mount 24. The press roller arms 27 are pivoted by a piston-and-cylinder device 28 and are mounted on a carriage 26 which is movable in guide members 29 on the press roller mount 24.

A sleeve gripper 33 is located above the supporting roll 6 in the free space between the rolls 7*r* to 11*r*. For this purpose a guide support 32 (FIG. 2) which extends over the length of the supporting roll 6 and somewhat beyond it runs under the guide crossmember 21 so that the winding sleeve 12 can be put on the sleeve gripper 33 outside the winding machine.

The sleeve gripper 33 comprises a carrier 31 which can travel on the guide support 32 on which a sliding mount 34 is guided slidably in a vertical direction.

A sleeve clamp holder 35 is pivotally mounted at a pivot axis 36 on the sliding mount 34.

The sliding mount 34 is pushed by a first piston-and-cylinder unit 37 while the sleeve clamp holder 35 is pivoted by a second piston-and-cylinder unit 38.

A sleeve clamp 39 comprising two clamp jaws is mounted on the free end of the sleeve clamp holder 35 facing the supporting roll 6. The winding sleeve 12 is held in the sleeve clamp 39 by clamp rollers 40.

During the winding the sleeve gripper 33 is pushed on the guide support 32 until it lies outside the vicinity of the supporting roll 6. Then the winding sleeves 12 are deposited by hand on two adjacent sleeve grippers 33 and pushed along the guide support 32 over the supporting roll 6.

Although the winding rolls have pairwise aligned end faces, the winding sleeve 12 can be pushed in the winding machine with facing ends pushed one against the other until the first winding sleeve 12 engages on a stop member at the final winder support member 14 corresponding to winding stations 8 (FIG. 3). The other winding sleeves 12 are exactly positioned in the vicinity of the winding stations 7, 9, 10, 11 with sufficient longitudinal precision.

After the rolls are finished winding, they are taken from the winding machine and empty sleeves 12 must be mounted in the winding stations 7 to 11. For this purpose the second piston-and-cylinder unit 38 is next operated to pivot the sleeve clamp holder 35, and the sliding mount 34 is lowered subsequently with the aid of the first piston-and-cylinder unit 37. Thus the winding sleeve 12 reaches the vicinity of the mandrel 17 on the roll carriage 15.

The mandrels 17 are inserted in the winding sleeve 12 with the aid of the traveller motor 16 and the sleeve gripper 33 is brought back into its original position. The winding sleeves 12 are released from the sleeve clamp 39. Now the sleeves 12 held by the mandrels 17 on the roll sliding members 15 travel toward the supporting roll 6 and the press roll arms 27 with the press rollers 30 lower to the winding sleeve 12 and the winding can begin.

Figure 2:
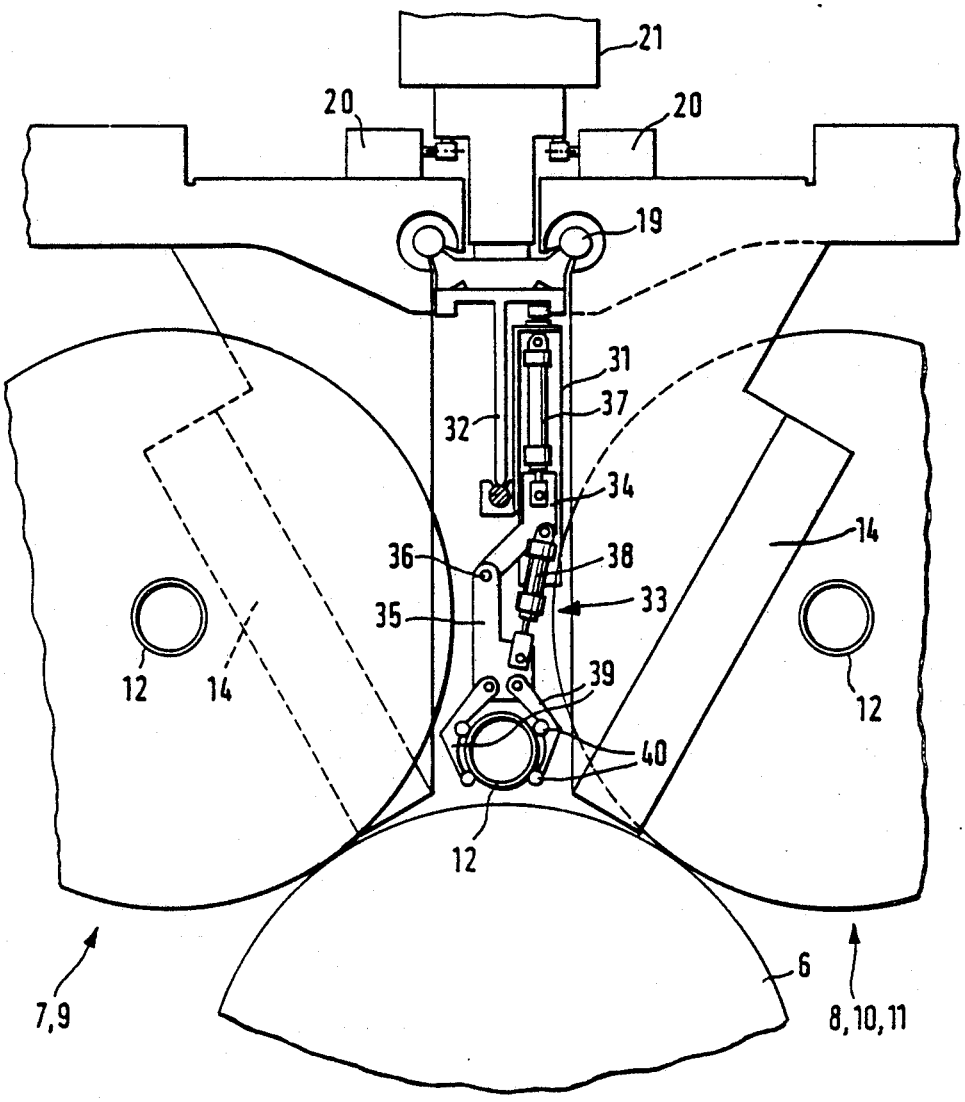
FIG. 2 is an enlarged side elevational view of the winding sleeve gripper of FIG. 1.
Figure 4:
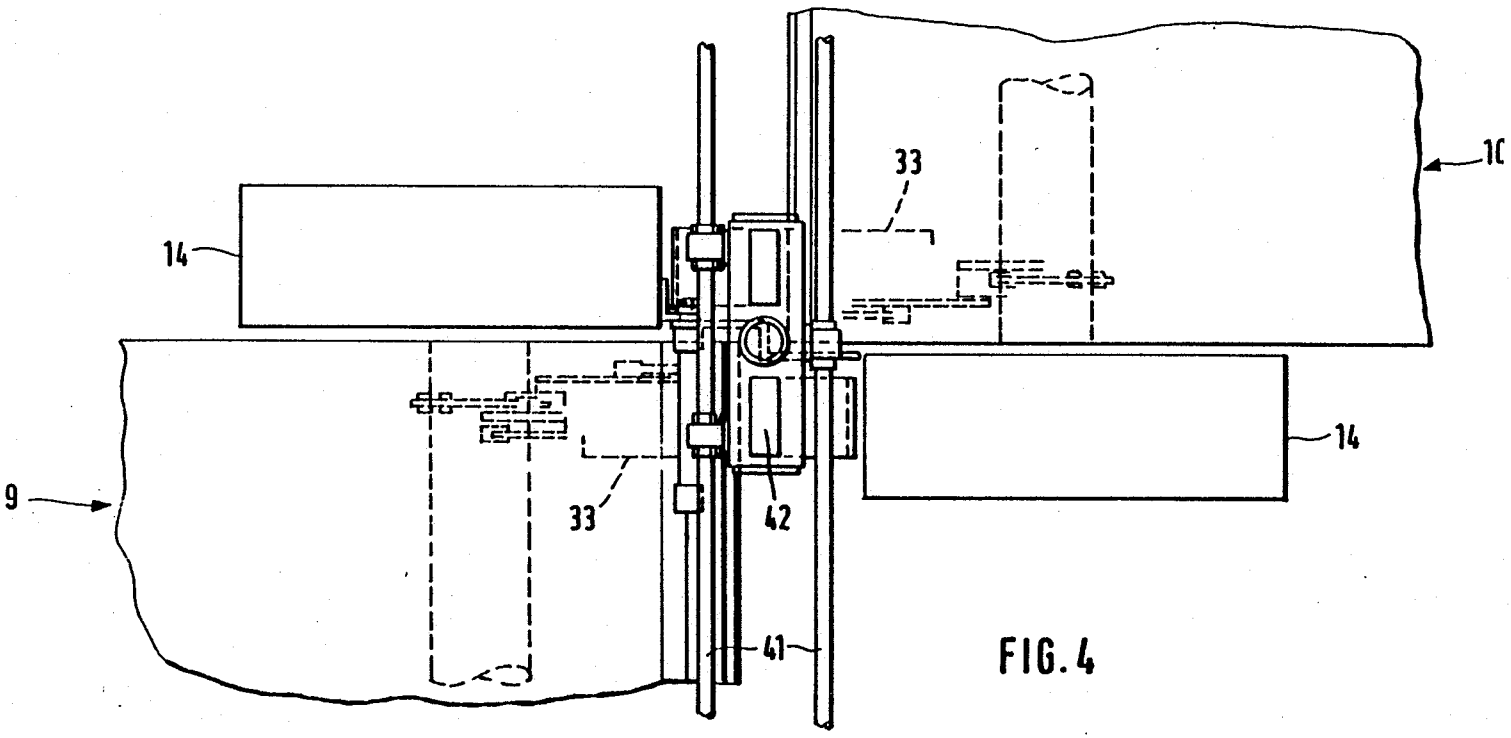
FIG. 4 is an enlarged partially cutaway top view of the winding machine according to our invention.
Figure 5:
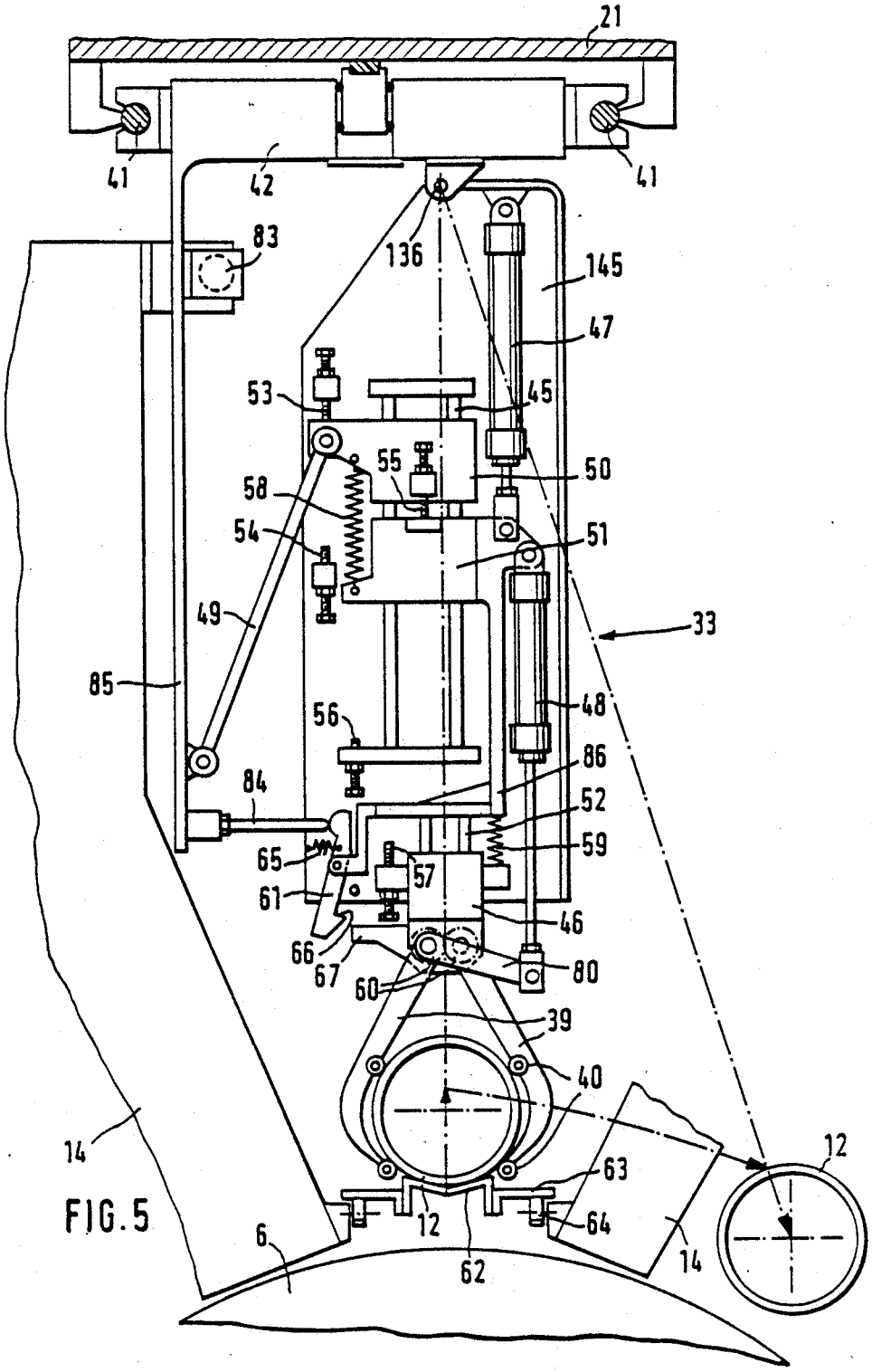
FIG. 5 is a partially cutaway plan view of the winding machine with a winding sleeve grippe and a winding sleeve channel.

While the guide support 32 in FIG. 2 is formed as a T-support, the parallel guides 41 (which are guide rods here in this example) are shown in FIGS. 3, 4 and 5 on which sliding supports 42 are slidably mounted. These sliding supports 42 may lock or index themselves on the guide crossmember 21 when they have taken the correct position in relation to the winding stations 7 to 11.

Two sleeve grippers 33 pivotable in opposite directions are pivotally mounted on each sliding support 42(FIGS. 3 and 4) and spacing retainers 44 are mounted between the individual sliding supports 42 so that longitudinal tolerances in the winding sleeves 12 have no influence on their position in regard to the winding stations 7 to 11. In these cases, sliding supports 42 connected by the spacing retainers 44 are pushed as a whole on the guides 41 from the vicinity of the supporting rolls 6 when the winding sleeves 12 as described above are deposited manually on the sleeve gripper 33.

An axial sliding of the sleeve gripper 33 is not required when, as illustrated in FIG. 5, a grooved sleeve member 62 is positioned in the longitudinal central plane above the supporting roll 6.

This grooved sleeve member 62 can rest with the guide rails 63 on bearing members 64 locally fixed on the supporting members 14 so that the winder supporting frame remains movable to fit roll shape changes, without which the grooved sleeve member 62 itself moves.

The winding sleeves 12 are pushed on the grooved sleeve member 62 in the winding machine and are located after the foremost is pushed against a stop member in the sleeve-receiving position in the vicinity of the winding stations 7 to 11.

It is also possible to arrange the grooved sleeve member 62 on the bearing members 64 to extend it from the vicinity above the supporting roll 6 and to cover the region outside the supporting roll 6 with winding sleeves 12.

Subsequently the grooved sleeve member 62 again is pushed in the winding machine until the winding sleeves 12 reach their designated position.

When the winding sleeves 12 are brought by the grooved sleeve member 62 to the sleeve-receiving position, it is not necessary to slide the sleeve gripper 33 independently of the winder support members 14 so that the winder support members 14 may be used as a support for the sleeve gripper 33. In FIG. 5 a sleeve gripper 33 is shown. It comprises a sliding support 42 which is slidable parallel to the supporting roll axis 6*a* on the guides 41 mounted on the guide crossmember 21. The longitudinal sliding of the sleeve gripper 33 with respect to the supporting member 14 is controlled by a piston-and-cylinder device 83 which connects the supporting member 14 and sliding support 42 with one another.

A pivoting holder 145 with a slider guide 45 is mounted on the sliding support 42 on a pivot axis 136 on which a two part sliding member 50,51 comprising an upper sliding member portion 50 and a lower sliding member portion 51 is guided.

A link member 49 is attached between the upper sliding member portion 50 and one lateral extension 85 of the sliding support 42. An additional slider guide 52 for a sleeve clamp holder 46 is positioned on another extension 86 of lower sliding member portion 51.

A third piston-and-cylinder unit 47 is pivotally connected to the pivoting holder 145 and to the lower sliding member portion 51. There is a fourth piston-and-cylinder unit 48 connected to a lower sliding member portion 51 and a closing lever 80 for the sleeve clamp 39.

A tension spring 58 is connected between the upper slider member portion 50 and the lower sliding member portion 51. Compression spring 59 is connected between the other extension 86 of lower sliding member portion 51 and the sleeve clamp holder 46.

The free displacement of the upper slider member portion 50 is limited by adjustable stop members 53, 54 attached to the pivoting holder 145.

The free displacement of the lower slider member portion 51 is limited by an adjustable limiting member 55 mounted on upper slider member portion 50 and an additional adjustable limiting member 56 mounted on the slider guide 45.

The displacement of the sleeve clamp holder 46 is predetermined in contrast by an adjustable contacting member 57 cooperating with the additional slider guide 52.

A bar 61 is pivotally connected to additional slider guide 52 and has a catch 66 on its free end which cooperates or acts together with a projection 67 on the sleeve clamp holder 46. The other free end of the bar 61 cooperates with a push rod 84 mounted on the lateral extension 85 of the sliding support 42 so that a disengagement in the illustrated vertical position of the pivoting holder 145 occurs.

In the position shown in FIG. the sleeve gripper 33 is located in the sleeve-receiving position. The third piston-and-cylinder unit 47 is entirely retracted so that the upper sliding member portion 50 lies on the stop member 53 and the lower sliding member portion 51 contacts on the limiting member 55. The link member 49 holds the slider guide 45 fixed in the illustrated vertical position. The fourth piston-and-cylinder unit 48 is already retracted from its completely extended position a certain amount so that the sleeve clamp 39 is closed on the winding sleeve 12.

To attain a uniform motion of both legs of the sleeve clamp 39, these legs are coupled with one another by gearing 60.

The piston rod of the fourth piston-and-cylinder unit 48 engages the sleeve clamp 39 by a closing lever 80. The sleeve clamp holder 46 is pushed by the compression spring 59 into the illustrated final position since the lock 61 is open.

If the fourth piston-and-cylinder unit 48 now moves further, the sleeve clamp holder 46 with the sleeve clamp 39 and the winding sleeve 12 is lifted so that the sleeve gripper 33 may swing from the sleeve-receiving position into the sleeve-delivery position. That occurs when the third piston-and-cylinder unit 47 is extended or drives outward. The lower sliding member portion 51 slides downwardly and takes along the upper slider member portion 50 by the tension spring 58 whereby the linking member 49 pushes the pivoting holder 145 with the slider guide 45 in the pivoted out position (dot-dashed position).

Then the catch 66 engages behind the projection 67. As soon as the upper slider member portion 50 meets the stop member 54 it remains in place and only the lower sliding member portion 51 moves further so that the sleeve gripper 33 extends until in its sleeve-delivery position.

To open the sleeve clamp 39, the fourth piston-and-cylinder unit 48 is extended anew. Since the bolt 61 with its catch 66 in the meantime is engaged behind the projection 67, the sleeve clamp holder 46 does not slide but the sleeve clamp 39 opens directly.

After accepting the winding sleeve 12 on the mandrel 17 on two adjacent winder support members 14 the third and fourth piston-and-cylinder units 47,48 are operated anew so that the sleeve gripper 33 returns to the sleeve-receiving position.

Figure 6:
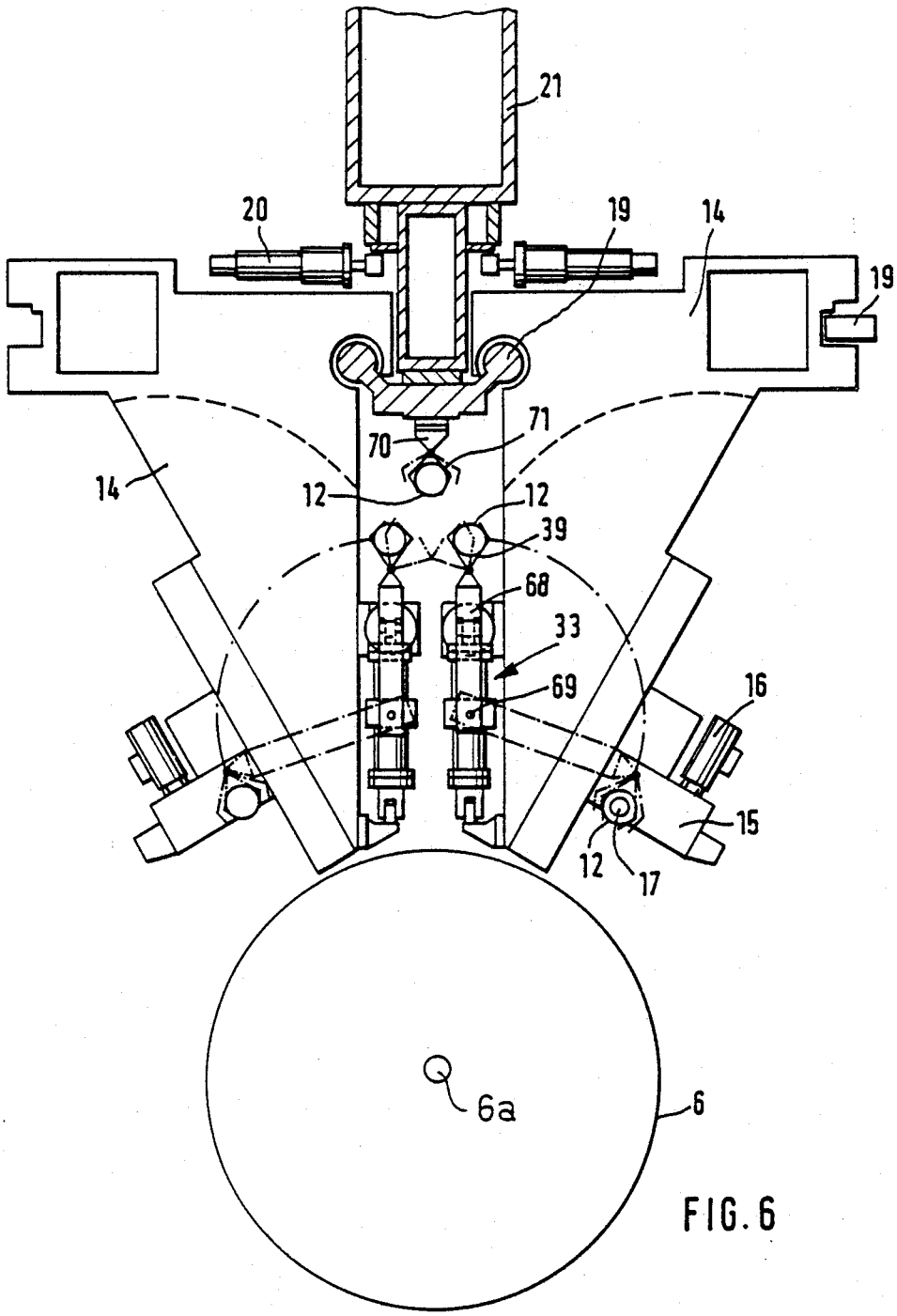
FIG. 6 is a partially cutaway plan view of a winding machine with a winding sleeve gripper mounted on a winder support member.

Also in the example according to FIG. 6 the sleeve grippers 33 are mounted on the support members 14. They comprise a simple pivot lever 68 in this example which is mounted on a pivot 69 in the support member 14. A sleeve clamp 39 is mounted on the upwardly directed free end of the pivot lever 68.

Pivot 69 is located on the support member 14. The length of the pivot lever 68 is such that the sleeve clamp 39 arrives in the vicinity of the mandrel 17 on the support member 14 on pivoting the pivoting lever 68 by a pivoting drive, for example an electrical drive, and the winding sleeve 12 can be delivered. To make delivering the winding sleeve 12 easy, the sleeve clamps 39 are pivotable to the pivot lever 68.

A sleeve carrier 70 is located above the pivot levers 68 on the guide crossmember 21 which is provided with the sleeve clamp 71. The winding sleeves 12 are inserted on these sleeve clamps 71 which are subsequently delivered by the sleeve clamp 39 on the pivot lever 68. This sleeve carrier 70 can be mounted slidably on the guide crossmember 21 so that the winding sleeves 12 may be deposited on the sleeve clamp 71 outside the winding machine.

In case the sleeve clamps 39 on the pivot levers 68 have opened sufficiently far, the winding sleeves 12 can be pushed in at the height of the sleeve clamps 39 in the machine and are delivered by the sleeve clamps 39 on the pivot lever 68. In this case, however, the sleeve clamps 71 must be moved so that they release the winding sleeves 12 when the pivot lever 68 pivots from the sleeve-receiving position to the sleeve-delivery position. This is possible with a spring-loaded mounting of the sleeve clamps 71.

Figure 7:
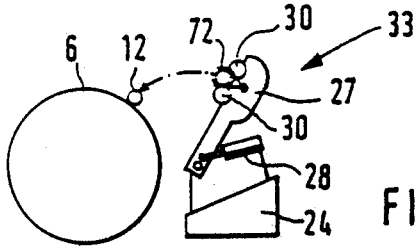
FIG. 7 is a partially cutaway plan view of a portion of a winding machine with a winding sleeve gripper in the form of a pivoting press roller.

In the example according to FIG. 7 the pivoting press roller arm 27 comprises the sleeve gripper 33. For this purpose a sleeve clamp 72 in which a winding sleeve 12 may be deposited is mounted on the press roller arm 27 in the vicinity of the press roller 30. The winding sleeve 12 contacts then on the press roller 30 and is positioned with the aid of this press roller 30 relative to the mandrel 17 on the support member 14. Since the pivoting press roller arms 27 are swung back during the winding, it is thus possible to deposit the winding sleeve 12 in the sleeve clamp 72 on the pivoting press rollers 27 during this time.

For cases in which the pivoting press roller arms 27 may not swing back sufficiently far from the structural base it is possible to provide an additional joint or link in the pivoting press roller arms 27 to swing back the press rollers 30 in this way into a nearly horizontal position. In this case a locking is required in the extended condition of the pivoting press roller arms 27 to attain the required pressure against the winding sleeve 12 to begin the winding process.

Figure 8:
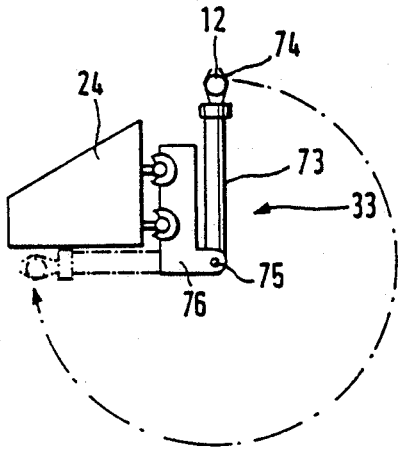
FIG. 8 is a partially cutaway view of a portion of a winding machine with another example of a winding sleeve gripper.

It is also possible to provide a sleeve gripper 33 on the press roller mount 24 as shown in FIG. 8. A carriage 76 is pivotally mounted on the press roller mount 24. A telescoping pivot lever 73 which carries on its free end a sleeve clamp 74 for receiving a winding sleeve 12 is pivotally mounted on the carriage 76 on a pivot bearing 75.

The sleeve clamp 74 is located in the illustrated position in a region of the winding machine which is accessible thus for depositing a winding sleeve 12. This is the sleeve-receiving position.

The delivery in the sleeve-delivery position is effected by pivoting approximately 270° about the pivot bearing 75 below the press roller mount 24. Then the telescoping pivot lever 73 is extended until the sleeve clamp 74 arrives in the vicinity of the mandrel 17 on the winder support member 14.

To also adjust the correct height of the sleeve clamp 74 with regard to the mandrel 17, either the press roller mount 24 may be adjusted in height by a lifting drive 25 (FIG.1) or the carriage 76 is mounted on the press roller mount 24 and adjustable in height.

Figure 9:
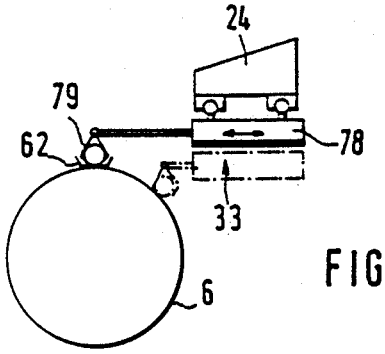
FIG. 9 is a partially cutaway view of a portion of a winding machine with a winding sleeve gripper formed as a piston-and-cylinder unit.

In case a grooved sleeve member 62 is located in the longitudinal central plane of the supporting roll 6 above the roll 6, the sleeve gripper 33 as shown in FIG. 9 may be formed as a piston-and-cylinder device which is mounted slidably below the press roller mount 24. To remove a winding sleeve 12 from the grooved sleeve member 62, the press roller mount 24 is lifted by the lifting drive 25 so that the sleeve clamp 79 mounted on the end of the piston-and-cylinder device 78 can take a winding sleeve 12 from the grooved sleeve member 62. Subsequently the piston-and-cylinder device is returned and the press roller mount 24 is lowered by the lifting drive 25 so that the winding sleeve 12 arrives in the vicinity of the mandrel 17 on the winder support member 14 and is taken by it.

By "carriage" referred to in the claims appended below we mean the carrier 31, the sliding support 42, sliding member 50,51 or the like used to slidably mount the sleeve gripper 33.

All examples of the sleeve gripper according to our invention have a sleeve gripper which may be provided without difficulty in a standard winding machine. If that were not the case, expensive structural conversion work would be required. The apparatus according to our invention may then be added subsequently to existing winding machines. This considerably simplifies and speeds the operation of these winding machines.

We claim:

1. An apparatus for inserting a winding sleeve into a winding machine, comprising:

at least one supporting roll, at least two winder support members with a plurality of mandrels positioned opposite one another for receiving said winding sleeve;

at least one sleeve gripper movable between a sleeve-receiving position and sleeve-delivery position substantially axially alignable with said mandrels, said sleeve gripper being mounted above said supporting roll pivotable between said sleeve-receiving position and said sleeve-delivery position transverse to the supporting roll axis, said sleeve gripper being pivotally mounted on a guide crossmember located above said supporting roll, to pivot about a pivot axis, and having a sleeve clamp mounted below said pivot axis of said sleeve gripper, said sleeve gripper being telescopically collapsible to achieve a variable length; and a carrier movable on a plurality of guide supports or guide rods on said guide crossmember and on which said sleeve gripper is mounted.

2. The improvement defined in claim 1 wherein two of said sleeve grippers are mounted on said carrier pivotable in opposite directions.

3. The improvement defined in claim 1 wherein said guide rods are extended beyond the length of said supporting roll.

4. The improvement defined in claim 3 wherein a plurality of sleeve grippers mounted on said carrier are provided and are coupled by a plurality of spacing retainers.

* * * * *